US009554686B2

(12) United States Patent
Davidshofer et al.

(10) Patent No.: US 9,554,686 B2
(45) Date of Patent: Jan. 31, 2017

(54) FLEXIBLE SCRUBBING HEAD FOR A FLOOR MOP

(71) Applicant: Electrolux Home Care Products, Inc., Charlotte, NC (US)

(72) Inventors: Donald Joseph Davidshofer, Mount Holly, NC (US); Saba Rizzi, Charlotte, NC (US); Craig Alan Amick, Davidson, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 555 days.

(21) Appl. No.: 14/035,431

(22) Filed: Sep. 24, 2013

(65) Prior Publication Data

US 2015/0082570 A1 Mar. 26, 2015

(51) Int. Cl.
*A47L 13/22* (2006.01)
*A47L 13/258* (2006.01)

(52) U.S. Cl.
CPC ..... *A47L 13/22* (2013.01); *A47L 13/225* (2013.01); *A47L 13/258* (2013.01)

(58) Field of Classification Search
CPC ..... A47L 13/22; A47L 13/225; A47L 13/254; A47L 13/258
See application file for complete search history.

(56) References Cited

U.S. PATENT DOCUMENTS

| | | | |
|---|---|---|---|
| 1,563,829 | A | 12/1925 | Brown |
| 2,205,535 | A | 6/1940 | Muckenhirn |
| 2,310,011 | A | 2/1943 | Cave et al. |
| 2,469,060 | A | 5/1949 | Vosbikian et al. |
| 2,678,458 | A | 5/1954 | Vosbikian et al. |
| 2,764,774 | A | 10/1956 | Belsky et al. |
| 2,804,638 | A | 9/1957 | Vosbikian et al. |
| 3,006,668 | A | 10/1961 | Stewart |
| 3,050,762 | A | 8/1962 | Ballinger |
| 3,362,037 | A | 1/1968 | Griffin |

(Continued)

FOREIGN PATENT DOCUMENTS

| | | |
|---|---|---|
| DE | 19908259 | 8/2000 |
| EP | 0426209 | 5/1991 |

(Continued)

OTHER PUBLICATIONS

Office Action mailed Mar. 29, 2016 for U.S. Appl. No. 14/035,472.

(Continued)

*Primary Examiner* — Randall Chin
(74) *Attorney, Agent, or Firm* — RatnerPrestia

(57) ABSTRACT

A mop having a handle and a base plate. The base plate has a lower surface configured to lie on a surface to be cleaned, and extends in a plane defined by a lateral direction and a longitudinal direction that is perpendicular to the lateral direction. The base plate is elongated in the lateral direction and includes a rigid central region that is connected to the handle, a flexing region, and a stepping region. The flexing region is made with an elastomeric material, and is connected at an inboard edge to a lateral end of the central region and extends to an outboard edge. The stepping region is connected to the outboard edge of the flexing region, and includes a generally flat upper surface configured to be stepped on by a user's foot.

20 Claims, 7 Drawing Sheets

(56) References Cited

U.S. PATENT DOCUMENTS 3,395,415 A 8/1968 Leland
3,440,677 A 4/1969 Flomerfelt
3,484,171 A 12/1969 Rosendall et al.
3,656,202 A 4/1972 Paton
3,720,974 A 3/1973 Rosendall
3,792,505 A 2/1974 Saltzstein
3,850,533 A 11/1974 Thielen
4,031,673 A 6/1977 Hagelberg
4,068,340 A 1/1978 Forward
4,127,911 A 12/1978 Cupp
4,165,550 A 8/1979 Burke
4,219,899 A 9/1980 Zurawin et al.
4,299,262 A 11/1981 Andrepont
4,327,459 A 5/1982 Gilbert
4,392,269 A 7/1983 Nishiyama et al.
4,433,451 A 2/1984 Parisi
4,658,461 A 4/1987 Roe et al.
4,845,800 A 7/1989 Pederson et al.
4,852,210 A 8/1989 Krajicek
4,858,962 A 8/1989 Bolling
4,864,675 A 9/1989 Jones
4,926,515 A 5/1990 Lynn et al.
5,067,400 A 11/1991 Bezella et al.
5,133,101 A 7/1992 Hauser et al.
5,232,298 A 8/1993 Mitsunari
5,323,506 A 6/1994 Babitch
5,341,541 A 8/1994 Sham
5,377,378 A 1/1995 Cutler
5,386,612 A 2/1995 Sham
5,502,872 A 4/1996 Chae
5,581,839 A 12/1996 Ferrell, Jr.
5,584,091 A 12/1996 Borofsky
5,591,507 A 1/1997 Jones
5,613,271 A 3/1997 Thomas
5,625,918 A 5/1997 Kieson et al.
5,876,141 A 3/1999 Hsu
5,881,423 A 3/1999 Shumway et al.
5,887,314 A 3/1999 Jordan, Jr.
5,888,006 A 3/1999 Ping
5,901,402 A 5/1999 Williams
5,920,952 A 7/1999 Baldacci
5,988,920 A 11/1999 Kunkler et al.
6,003,191 A 12/1999 Sherry et al.
6,087,279 A 7/2000 Laun
6,101,661 A 8/2000 Policicchio et al.
6,119,298 A 9/2000 Kenmochi
6,148,144 A 11/2000 Milanese
6,289,551 B1 9/2001 Basile
6,305,046 B1 10/2001 Kingry et al.
6,336,240 B1 1/2002 Laux et al.
6,397,427 B1 6/2002 Bryngelsson
6,453,506 B1 9/2002 Sumner
6,463,620 B2 10/2002 Busha
6,487,746 B1 12/2002 Cioci
6,502,275 B1 1/2003 Hsieh
6,540,424 B1 4/2003 Hall et al.
6,546,584 B2 4/2003 Hobden
6,571,421 B1 6/2003 Sham et al.
6,579,023 B2 6/2003 Kunkler
6,584,990 B2 7/2003 Shaw
6,591,442 B2 7/2003 Kaminstein
6,606,757 B2 8/2003 Vosbikian et al.
6,640,383 B2 11/2003 Tsen
6,663,306 B2 12/2003 Policicchio
6,669,391 B2 12/2003 Policicchio
6,692,172 B1 2/2004 Hsu
6,716,805 B1 4/2004 Sherry et al.
6,722,806 B2 4/2004 Kunkler
6,814,519 B2 11/2004 Policicchio
6,820,301 B2 11/2004 Petner
6,823,559 B2 11/2004 Kaffenberger
6,836,921 B1 1/2005 Petner
6,842,936 B2 1/2005 Policicchio et al.
6,854,911 B2 2/2005 Policicchio
6,871,372 B2 3/2005 Vosbikian et al.
6,889,917 B2 5/2005 Fahy et al.
6,892,415 B2 5/2005 Libman et al.
6,893,180 B2 5/2005 Hall
6,899,485 B2 5/2005 Hall
6,910,823 B2 6/2005 Policicchio
6,934,995 B2 8/2005 Wheeler
6,948,873 B2 9/2005 Policicchio
6,953,299 B2 10/2005 Wang et al.
6,960,042 B1 * 11/2005 Hsiao ..... A47L 1/08 401/138
6,964,535 B2 11/2005 Bell
6,976,802 B2 12/2005 Hall
6,986,618 B2 1/2006 Hall
6,990,708 B2 1/2006 Rosa
7,007,338 B2 3/2006 Garabedian, Jr. et al.
7,028,364 B2 4/2006 Policicchio
7,033,965 B2 4/2006 Takabayashi et al.
7,048,804 B2 5/2006 Kisela
7,055,204 B2 6/2006 Ajluni
7,059,011 B2 6/2006 Capitani
7,096,531 B2 8/2006 Policicchio
7,124,464 B2 10/2006 Williams et al.
7,127,772 B2 10/2006 Dingert et al.
7,137,169 B2 11/2006 Murphy
7,144,173 B2 12/2006 Policicchio
7,163,349 B2 1/2007 Policicchio
7,182,537 B2 2/2007 Policicchio
7,185,392 B2 3/2007 Murray
7,225,495 B2 6/2007 Berti et al.
7,264,413 B2 9/2007 Vosbikian et al.
7,293,322 B2 11/2007 Matousek
7,313,843 B2 1/2008 Brinker et al.
7,343,638 B2 3/2008 Mitchell et al.
7,350,257 B2 4/2008 McKay
7,380,307 B2 6/2008 Tsai
7,428,768 B2 9/2008 Dingert
7,465,115 B2 12/2008 Suda
7,536,743 B2 5/2009 Goh et al.
7,566,671 B2 7/2009 Hoadley
7,574,768 B2 8/2009 Morris et al.
7,618,206 B2 11/2009 Sacks
7,640,626 B2 1/2010 Oh
7,648,303 B2 1/2010 Zorzo
7,665,180 B2 2/2010 Haan
7,699,551 B2 4/2010 Suda
7,721,381 B2 5/2010 Michelson et al.
7,740,193 B2 6/2010 Soller et al.
7,779,501 B2 8/2010 Lacotta et al.
7,841,039 B1 11/2010 Squire
7,841,040 B2 11/2010 Strunk et al.
7,856,691 B2 12/2010 Viggiani
7,891,047 B2 2/2011 Milanese
7,895,697 B2 3/2011 Cassar
7,930,798 B2 4/2011 Zhou
8,052,342 B2 11/2011 Rosenzweig
8,056,181 B2 11/2011 Kim
8,069,520 B2 12/2011 Mattucci et al.
8,142,094 B2 3/2012 Kaleta
8,166,597 B2 5/2012 Levitt et al.
8,171,592 B2 5/2012 Tsai
8,186,898 B2 5/2012 Bradbury
8,205,288 B2 6/2012 Broman et al.
8,205,293 B2 6/2012 Rosenzweig
8,239,999 B2 8/2012 Hsu
8,245,351 B2 8/2012 Rosenzweig
8,250,700 B2 8/2012 Pung et al.
8,261,402 B2 9/2012 Rosenzweig
8,267,607 B2 9/2012 Harris
8,276,234 B2 10/2012 Hsu
8,286,294 B2 10/2012 Cassar
8,407,848 B2 4/2013 Pung et al.
8,449,682 B2 5/2013 Perelli et al.
8,464,389 B2 6/2013 Jiang et al.
8,464,391 B2 6/2013 Bober et al.
8,533,888 B2 * 9/2013 Kessler ..... A47L 23/22 15/104.92
2002/0194693 A1 12/2002 Wu
2003/0028988 A1 2/2003 Streutker et al.
2003/0044569 A1 3/2003 Kacher et al.

(56) References Cited

U.S. PATENT DOCUMENTS

| | | | | |
|---|---|---|---|---|
| 2003/0126710 | A1 | 7/2003 | Policicchio | |
| 2004/0146332 | A1 | 7/2004 | Fu | |
| 2004/0231700 | A1 | 11/2004 | Bell et al. | |
| 2007/0130713 | A1 | 6/2007 | Chen et al. | |
| 2008/0222825 | A1 | 9/2008 | Sampaio | |
| 2009/0235476 | A1 | 9/2009 | Cioci | |
| 2009/0249570 | A1 | 10/2009 | Rosenzweig et al. | |
| 2010/0199455 | A1 | 8/2010 | Vrdoljak | |
| 2011/0020051 | A1* | 1/2011 | Robertson | A47L 13/22 401/268 |
| 2011/0167583 | A1 | 7/2011 | Weaver et al. | |
| 2011/0185529 | A1 | 8/2011 | Kandasamy et al. | |
| 2011/0219581 | A1 | 9/2011 | Vines | |
| 2011/0223375 | A1 | 9/2011 | Kaminer | |
| 2012/0195674 | A1 | 8/2012 | Mandle et al. | |
| 2012/0269567 | A1 | 10/2012 | Crawford et al. | |
| 2013/0067673 | A1 | 3/2013 | Yu | |
| 2014/0245556 | A1* | 9/2014 | Kaminer | A47L 11/284 15/228 |

FOREIGN PATENT DOCUMENTS

| | | |
|---|---|---|
| EP | 0430846 | 6/1991 |
| EP | 1985221 | 10/2008 |
| GB | 2276811 | 10/1994 |
| WO | WO9740736 | 11/1997 |

OTHER PUBLICATIONS

Notice of Allowance mailed Jun. 8, 2015 for U.S. Appl. No. 13/833,571.

Office Action mailed Jan. 16, 2015 for U.S. Appl. No. 13/833,571.

Office Action mailed Mar. 10, 2015 for U.S. Appl. No. 14/043,346.

Office Action mailed Mar. 11, 2015 for U.S. Appl. No. 14/035,455.

Photographs of Dirt Devil Products publicly available before Sep. 24, 2013, 6 pages.

Entire patent prosecution history of U.S. Appl. No. 13/833,571, filed Mar. 15, 2013, entitled, "Steam Distribution Apparatus and Methods for Steam Cleaning Devices."

Entire patent prosecution history of U.S. Appl. No. 14/035,455, filed Sep. 24, 2013, entitled, "Sliding Scrub Brush for a Floor Mop."

Entire patent prosecution history of U.S. Appl. No. 14/035,472, filed Sep. 24, 2013, entitled, "Floor Mop With Concentrated Cleaning Feature."

Entire patent prosecution history of U.S. Appl. No. 14/043,346, filed Oct. 1, 2013, entitled, "Floor Mop With Removable Base Plate."

* cited by examiner

FIG. 2
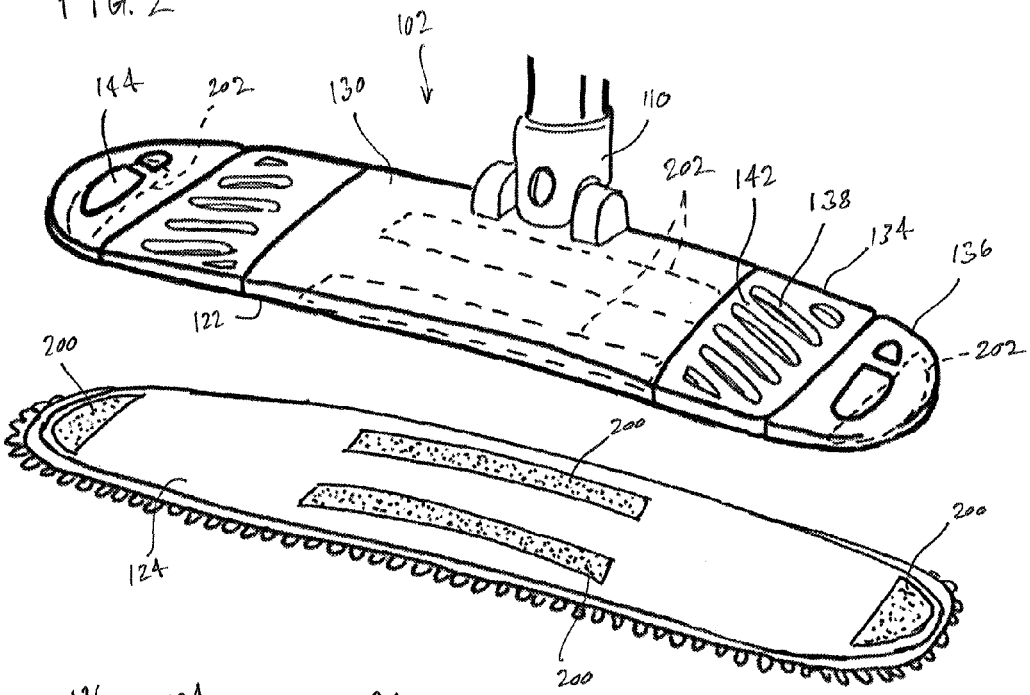
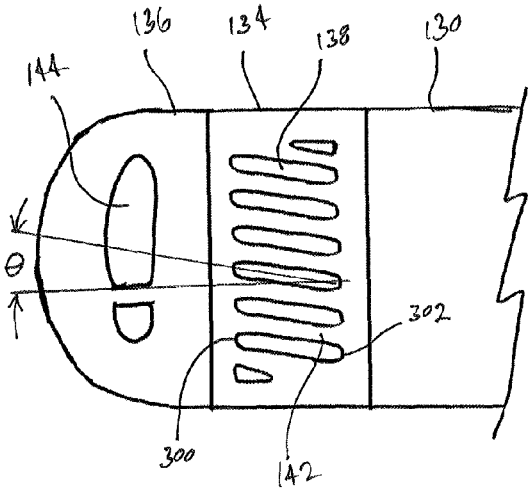
FIG. 3
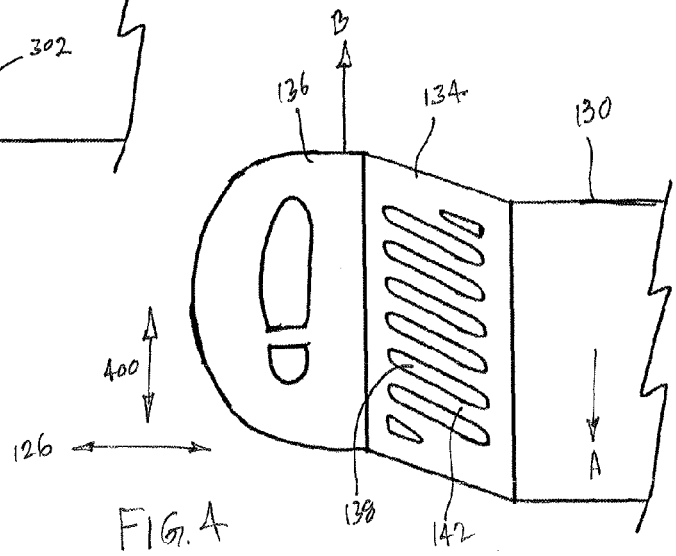
FIG. 4

FLEXIBLE SCRUBBING HEAD FOR A FLOOR MOP

CROSS-REFERENCE TO RELATED APPLICATIONS

The present application is related to U.S. patent application Ser. No. 14/035,455, now abandoned; and 14/035,472, now abandoned, which are incorporated herein by reference.

FIELD OF THE INVENTION

The present invention relates to floor mops, and more particularly to floor mops having one or more flexible regions on the base plate.

BACKGROUND

Spray Mops are simple cleaning tools that have gained favor by consumers following a recent trend in the popularity of hard floor surfaces (e.g., tile, wood, stone, marble, linoleum etc.) within the housing market. Early hard floor cleaning tools typically comprised a string mop, rag mop, or sponge mop that was used in conjunction with a separate bucket of cleaning solution. Such devices are still in use today, and can be effective, but they are often considered cumbersome to use.

The foregoing mopping devices have been replaced in the marketplace with increasing frequency by flat mops having a flat base plate mounted to a long handle, with a removable cleaning pad attached to the base plate. Such cleaning pads have included traditional woven fabrics (e.g., string or a knit fabric), sponges, nonwoven fabrics made of polymers, wood pulp, or the like, and the like. Woven and sponge mop pads are generally considered to be reusable, whereas nonwoven pads are often considered to be "disposable" because they are difficult or impossible to effectively clean for multiple reuses.

Flat mops may be used with a separate supply of cleaning fluid (water, detergent or the like), but some are equipped as a "spray mop" having a built-in fluid deposition system including a spray nozzle attached either to the base plate or the handle, a vessel filled with liquid cleaning fluid, and mechanism to control the flow of cleaning fluid. Such mechanisms have included, among other things, manually- and electrically-operated pumps, and gravity-operated systems controlled by a valve. The spray frequency and duration are controlled by the user using a hand trigger located on or close to the handle grip. Once the vessel is filled with the cleaning solution of choice and the cleaning pad is installed, the user places the base plate on the target surface (typically a floor) and energizes the spray system by squeezing the hand trigger or other mechanism to wet the surface. Once the surface is wetted, the user moves the spray mop pad across the wet surface in forward/aft or left/right directions to wick up the cleaning solution and apply a light downward force to transfer the dirt from the floor to the (now wet) pad.

The base plate of a flat mop typically has a large surface (e.g., ~400 mm wide×~100 mm deep). The large surface area provided by the base plate and underlying pad provides a large cleaning path, which reduces the time required to clean large areas and provides a significant transfer surface to pick up dirt and liquid. However, the force applied by the user is spread across the total area of the pad (e.g., ~40,000 $mm^2$ in the above example), which is good for covering large areas, but hinders the cleaning result and efficiency when attempting to clean stubborn dirt because it is not possible to focus a large cleaning force on strongly-adhering dirt. Ethnographic observations reveal that users of flat mops address stubborn dirt in a variety of ways. Some users apply more cleaning solution (which is potentially wasteful), and others simply endure the many passes required with the cleaning pad (which is time consuming). Other users apply a greater amount of force to the stain using their sock-covered foot or a separate abrasive pad. Still others attempt to apply more force by moving one or both hands lower on the handle. In any event, these approaches are not considered to be true solutions to the problem of cleaning stubborn dirt, because they can be inconvenient and inefficient to the user.

Some existing flat mop designs attempt to address the issue of cleaning stubborn dirt by adding a scrub brush to the mop. For example, U.S. Pat. Nos. 6,892,415 and 7,225,495 and U.S. Publication No. 2012/0195674 (all of which are incorporated herein by reference) show mops having a scrub brush mounted on the head adjacent the sponge or cleaning pad. However, these devices all require the user to flip the mop head to perform the scrubbing operation, which can be an awkward and inconvenient movement. Furthermore, the device in the aforementioned publication uses a pivoting joint between the handle and the base plate, which may increase the difficulty of holding the device with the scrub brush facing towards the floor. Other devices, such as the mops shown in U.S. Pat. Nos. 7,779,501 and 8,166,597, have a scrubbing region built into the center of the base plate, which is activating by increasing the downward force on the mop handle. With these devices, it can be difficult or impossible to tell when the scrubbing region is actually moved into contact with the floor, because there is no separate control to operate it. Also, some of these devices sacrifice a portion of the main cleaning pad to make room for the scrubbing region.

There exists a need to provide alternative solutions to the problems of cleaning stubborn dirt using flat mops, spray mops, and the like.

SUMMARY

In one exemplary embodiment, there is provided a mop having a handle and a base plate. The handle has a proximal end and a distal end opposite the proximal end. The base plate has a lower surface configured to lie on a surface to be cleaned. The base plate extends in a plane defined by a lateral direction and a longitudinal direction that is perpendicular to the lateral direction, and is elongated in the lateral direction. The base plate includes a rigid central region, a first flexing region, and a first stepping region. The rigid central region has a first lateral end and a second lateral end opposite the first lateral end, and the rigid central region is connected to the proximal end of the handle between the first lateral end and the second lateral end. The first flexing region is made with an elastic material, and is connected at an inboard edge to the first lateral end of the rigid central region and extends in the lateral direction away from the rigid central region to an outboard edge. The first stepping region is connected to the outboard edge of the first flexing region, and includes a generally flat upper surface configured to be stepped on by a user's foot.

It will be appreciated that this Summary is not intended to limit the claimed invention in any way.

BRIEF DESCRIPTION OF THE DRAWINGS

A better understanding of the exemplary embodiments may be understood by reference to the attached drawings, in which like reference numbers designate like parts. The drawings are exemplary, and not intended to limit the claims in any way.

FIG. 2 is an exploded view of the base plate of the embodiment of FIG. 1.

FIG. 3 is a top view of one lateral end of an exemplary base plate of a spray mop.

FIG. 4 is a top view showing the embodiment of FIG. 3 in one mode of use.

BRIEF DESCRIPTION OF EMBODIMENTS

The inventors have developed new apparatus and methods for cleaning stubborn dirt using a flat mop or spray mop. Non-limiting examples of these apparatus and methods are described below. The following embodiments generally describe the inventions in the context of a spray mop, but it will be readily apparent that these embodiments are also applicable to flat mops that do not have a separate liquid depositing system.

Figure 1:
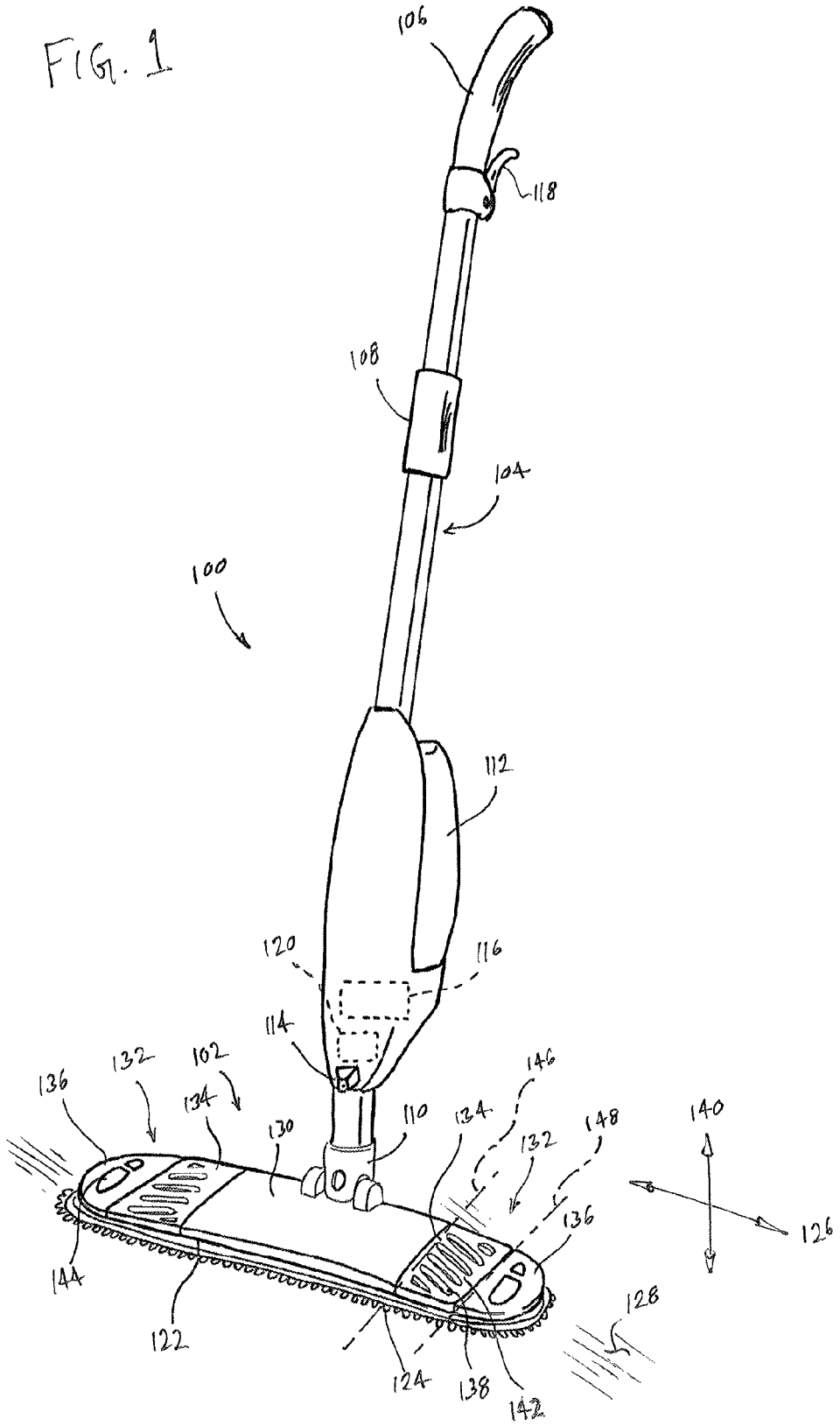
FIG. 1 is an isometric view of an exemplary embodiment of a spray mop having a flexible scrubbing head.

FIG. 1 illustrates an exemplary embodiment of a spray mop 100 that is adapted for quick and convenient cleaning of stubborn dirt. As used herein, the term "dirt" is intended to have its broad colloquial meaning, and includes any substance on a surface that is desired to be removed therefrom. This term includes, without limitation, soil, food, liquids, or other substances that are on or adhering to the surface.

The exemplary spray mop 100 includes a base plate 102 to which a handle 104 is attached. The handle 104 is attached at a proximal (lower) end to the base plate 102, and may include a first grip 106 at a distal (upper) end. The first grip 106 may be connected to the handle as an integrally-molded part, or as separate piece that is attached at the distal end of the handle 104. The handle 104 also may include a second grip 108 at a location between the proximal and distal ends of the handle 104. The grips 106, 108 may be contoured or have gripping material (e.g., overmolded rubber, etc.) to facilitate the user's operation of the mop 100.

The handle 104 is connected to a top side of the base plate 102 via a joint 110. The joint 110 may be a rigid connection, but more preferably is a pivot joint. A pivot joint may be a single-axis pivot that allows the base plate 102 and handle 104 to rotate relative to one another about a single axis, or a multiple-axis pivot that allows the base plate 102 and handle 104 to rotate relative to one another about multiple (e.g., two) axes. Such pivot joints are known in the art, and an example of a suitable pivot joint is shown in U.S. Pat. No. 5,876,141, which is incorporated herein by reference.

The handle 104 may include a fluid deposition system for distributing cleaning fluid (water, detergent, etc.) onto the surface being cleaned. The fluid deposition system includes a tank 112 to hold the cleaning fluid, a sprayer 114 that is positioned and oriented to distribute the fluid in the desired direction, a pump and/or valve assembly 116 to control the fluid flow, and a trigger 118 that is operated by the user to activate the pump/valve assembly 116. The details of such fluid deposition systems are known in the art, and need not be described herein. Examples of suitable fluid deposition systems include, for example, those shown in U.S. Pat. Nos. 5,888,006; 6,659,670; 6,960,042; 6,692,172; 6,722,806; 7,004,658; 7,048,458; 7,160,044; 7,172,099; and 7,850,384, which are incorporated herein by reference. Without excluding other options, the inventors believe that the system shown in U.S. Pat. No. 6,960,042 is expected to be particularly useful to provide simple and effective fluid deposition. In this embodiment, the fluid deposition system comprises a pump 116 that is fluidly connected to the tank 112 to receive the cleaning fluid, and a sprayer 114 that is fluidly connected to the pump 116 to receive pressurized fluid and deposit the fluid onto the surface to be cleaned. Fluid connections may be made by hoses or rigid passages formed in the handle housing. The pump 116 may be a simple plunger pump that is operated by a trigger 118 located at the grip 106 via a linkage that extends down the length of the handle 104. The tank 112 may be removable for refilling or replacement, or fixed and refilled in place. The foregoing features and variations are well-known in the art, and need not be described herein.

It will be appreciated that various modifications may be made to the foregoing embodiment. For example, the fluid deposition system may be omitted to provide a simple flat mop. As another example, the fluid deposition system may be modified by placing the sprayer 114 or other parts, such as the tank 112, on the base plate 102. As yet another example, a heater 120 may be added in the fluid lines (or to the tank 112) to heat the liquid and/or convert the liquid into steam prior to deposition on the surface being cleaned. As still another example, a vacuum system (i.e., a vacuum suction fan and motor, and associated dirt receptacle), may be added to the mop 100. An example of such a system is shown, in conjunction with an optional steam generator, in U.S. Pat. No. 6,571,421, which is incorporated herein by reference. Other variations and modifications will be apparent to persons of ordinary skill in the art in view of the present disclosure.

The base plate 102 comprises a generally flat lower surface 122 that faces the floor or other surface during use. If desired, the lower surface 122 may have grooves or an arched shape (as viewed from the longitudinal direction 400 and/or lateral direction 126) to help distribute forces across the lower surface 122, or other features that may be useful to enhance cleaning (e.g., steam outlets).

The base plate 102 is configured as a scrubbing head by including one or more features to scrub the underlying floor. For example, the lower surface 122 may include an integral cleaning member, such as permanently-affixed bristles or the like. Alternatively, the base plate 102 may be equipped with a replaceable cleaning pad 124. A replaceable pad 124 may comprise a nonwoven material, a woven fabric, or any other suitable cleaning medium. The pad 124 may be connected to the base plate 102 by hook-and-loop fasteners, adhesives, press-in fittings, wrapping portions of the pad 124 around the base plate 102, and so on. Non-limiting examples of pad materials and mechanisms for attaching the pad to the base plate 102 are described in U.S. Pat. Nos. 4,031,673; 6,003,191; 6,305,046; 6,716,805; 6,692,172; 7,350,257; 7,721,381, and 8,464,391, which are incorporated herein by reference. In one exemplary embodiment, the pad 124 comprises a reusable and washable pad comprising one or more woven fabric layers, and the top of the pad 124 and lower surface 122 of the base plate 102 have complementary hook-and-loop fasteners that releasably join the two together during use. In other embodiments, the pad 124 may be a disposable, nonwoven pad.

Referring now also to FIG. 2, the base plate 102 preferably is elongated in a lateral direction 126, so that the full lateral width of the base plate 102 passes across the surface being cleaned 128 during each forward and backward stroke. The base plate 102 comprises a rigid central region 130, and flexible end regions 132 extending laterally from each lateral end of the rigid central region 130. In the shown embodiment, there are two flexible end regions 132, but in other embodiments one of the flexible end regions 132 may be omitted and replaced by a continuation of the rigid central region 130 or other structures.

The rigid central region 130 comprises a rigid housing or structure that preferably does not appreciably flex during normal operation of the mop 100. Suitable materials include metals (e.g., aluminum, steel or magnesium), or plastics (e.g., acrylonitrile butadiene styrene (ABS), polycarbonates, polystyrene, polyvinyl chloride (PVC), or the like). Conventional materials and constructions may be used to form the rigid central region 130. The rigid central region 130 may have any width (i.e., the dimension in the lateral direction 126), but in one embodiment the width of the rigid central region 130 is about 200 millimeters, and the overall width of the complete base plate 102 is about 400 millimeters.

Each flexible end region 132 preferably comprises a flexing region 134 located proximal to the rigid central region 130, and a stepping region 136 located at the free end of the flexible end region 132 and distally from the rigid central region 130. The stepping regions 136 preferably are located at the lateral ends of the base plate 102, but this is not strictly required in all embodiments.

Each flexing region 134 preferably comprises a flexible elastic material that has the ability to flex and then return to its original unflexed position. Examples of suitable materials include elastomeric polymers, such as natural rubber (which may be vulcanized or otherwise processed), synthetic rubber (e.g., styrene-butadiene, butyl rubber, etc.), thermoplastic elastomers ("TPE," such as thermoplastic polyurethanes), silicone, and the like. While elastomeric materials are preferred for the embodiment of FIG. 1, the flexing regions 134 alternatively may comprise a thin metal sheet or regular thermoplastics or structural plastics that are modified to make them highly flexible (e.g., by making them very thin or including perforations or other stiffness-reducing structural modifications). An inboard edge of each flexing region 134 is connected to the rigid central region 130 by fasteners, adhesives, overmolding, friction fitments, combinations of the foregoing, or other mechanisms known in the art. Each flexing region 134 extends in the lateral direction 126 away from the rigid central region 130 to an outboard edge at which the stepping region 136 is connected to the flexing region. The terms "inboard" and "outboard" will be understood to refer to positions relative to a centerline of the base plate 102 in the longitudinal direction (i.e., the direction perpendicular to the lateral direction 126 and parallel with the surface being cleaned 128 when the base plate 102 lies thereon), with "inboard" being closer to the centerline, and "outboard" being further from the centerline.

The flexing regions 134 are configured to allow vertical movement of the stepping regions 136 during normal operation of the mop 100. Also, as described in more detail below, the flexing regions 134 also allow the stepping regions 136 to be pressed downward into the surface being cleaned 128 by a force from the user's foot, without significantly distributing the force across a large area of the base plate 102. The flexing regions may have any suitable width (i.e., the dimension in the lateral direction 126), but in one embodiment the width is at least about 25 millimeters, and in another embodiment the width is about 50 millimeters.

The stiffness of the flexing regions 134 may be selected by appropriate material selection and engineering of the shape and dimensions of the flexing regions 134. For example, the flexing regions 134 may comprise a natural or synthetic rubber having a thickness (i.e., the dimension in the vertical direction 140 perpendicular to the surface 128 being cleaned when the base plate 102 is lying on the surface 128) of about 4 millimeters to about 20 millimeters.

Figure 6:
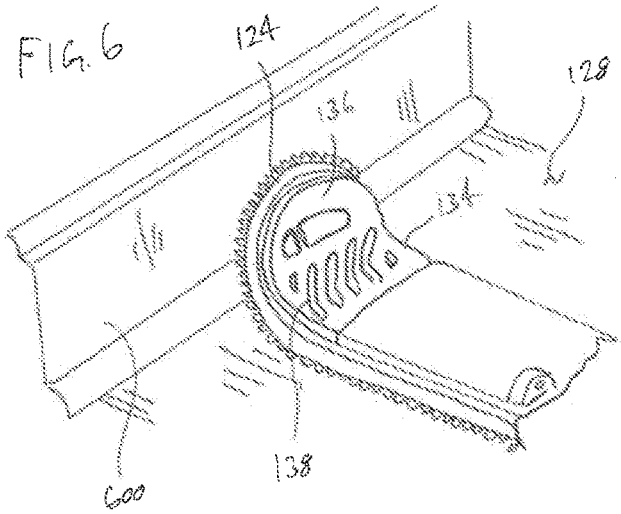
FIG. 6 is an isometric view of the embodiment of FIG. 3 in another mode of use.

The flexing regions 134 also may include grooves or openings to modify their flexibility or to provide other functions. For example, in one preferred embodiment, each flexing region 134 may comprise a plurality of slots 138 that extend from the stepping region 136 towards the rigid central region 130. These slots 138 divide the flexing regions 134 into a plurality of ribs 142 that join the rigid central region 130 to the stepping regions 136. This arrangement of slots 138 is expected to reduce the resistance of the flexing regions 134 to flexing in the vertical direction 140. Furthermore, using a number of slots or other openings is expected to be more advantageous than using a single large opening, because the ribs 142 or other structures between the openings provide a number of locations along the length (i.e., the dimension in the longitudinal direction 400) of the flexing region 134 to abut and press downward on the underlying pad 124. If the flexing region 134 has openings, it is preferred that there are a sufficient number of ribs 142 to abut the cleaning pad 124 at three or more locations along the length of the flexing region 134 (or the width, in the case of FIG. 8), but providing more locations (i.e., 4 or more) is more preferred. It will be appreciated that, in some embodiments, contact between the ribs 142 and the pad 124 may not be continuous during operation of the mop 100, but rather may occur only when the flexing region 134 is flexed, such as shown in FIG. 6.

Other embodiments may use other patterns of ribs and openings through the flexing regions 134, such as a grid pattern of square or circular openings, or a random-appearing arrangement of openings, or the like, to provide the desired flexibility while still providing a generally continuous structure to press down on the cleaning pad 124. Still other embodiments may use cutouts at the edges of the flexing region 134, so that the openings are shaped like notches along the front, back or side edges of the flexing region. Furthermore, while the shown ribs 142 are straight, the ribs 142 may be curved or have irregular shapes (see, e.g., the hourglass-shaped ribs 804 in FIG. 8).

In embodiments of flexing regions that are unapertured (i.e., that do not have openings), the flexing region 134 may abut the cleaning pad 124 continuously along the length of the flexing region 134. Alternatively, the flexing region 134 may have contours or cutouts that cause the flexing region 134 to contact the cleaning pad 124 at a limited number of locations along its length. Other variations and modifications will be apparent to persons of ordinary skill in the art in view of the present disclosure.

Although the foregoing use of multiple openings (or no openings) is preferred to ensure a better distribution of downward force on the pad 124, other embodiments may use a single large opening. In such embodiments, however, the area within the opening will not contain any structure to press down on the pad 124, which may reduce cleaning effectiveness under the flexing region 134.

The stepping regions 136 are connected to the outboard edge of each respective flexing region 134. Such connection may be made by integral forming, fasteners, adhesives, overmolding, friction fitments, combinations of the foregoing, or other mechanisms known in the art. The stepping regions 136 are configured and dimensioned to be stepped on by the foot of the mop user to apply an increased local cleaning force beneath the stepping region 136. While it is not required in all embodiments, the stepping regions 136 preferably are at least somewhat less flexible than the flexing regions 134, to help transfer the user-applied force to the underlying surface 128. For example, the stepping regions 136 may be constructed of the same material as the flexing regions 134, but made thicker to increase their stiffness relative to the flexing regions 134. As another example, the stepping regions 136 may be made of the same material as the flexing regions 134, but the flexing regions 134 may include openings, such as described above, to render the flexing regions 134 more flexible than the stepping regions 136. In this embodiment, the flexible end regions 132 may comprise a generally homogenous molded part, with the difference between the flexing regions 134 and stepping regions 136 being primarily that the flexing regions 134 include one or more openings. As still another example, the stepping regions 136 may comprise the same material as the flexing regions 134, but be reinforced using an internal or external base plate or rigid material. The stepping regions 136 also may be formed of materials that are different from the flexing regions 134; for example, they may be formed entirely of rigid materials such as those described above in relation to the rigid central region 130 or other materials.

Figure 5:
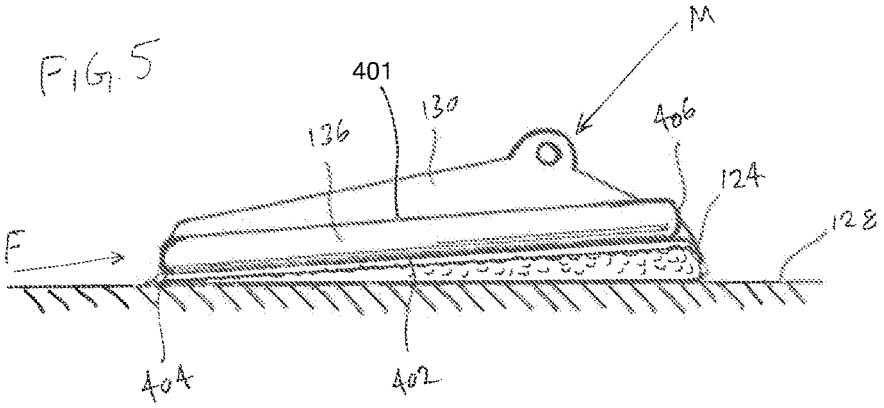
FIG. 5 is a side view showing the embodiment of FIG. 3 in another mode of use.

The stepping regions 136 may comprise generally solid portions of the flexible end regions 132 that are shaped and sized to be easily depressed by a user's foot without risk of misplacing the foot. To this end, each stepping region preferably comprises a generally flat upper surface 401 (FIG. 5) that is at least about 30 mm wide (as measured in the lateral direction 126), and more preferably at least about 40 mm wide, and at least about 30 mm long (as measured in the longitudinal direction 400), and more preferably at least about 40 mm long. A generally flat surface is preferred to make the application of force simpler and to prevent the user's foot from twisting as force is applied, but a flat surface is not strictly required in all embodiments. The bottom of each stepping region 136 also preferably is a flat surface 402 (FIG. 5). The use of flat surfaces is not strictly necessary, but it is expected to be helpful to provide a stable platform for the user's foot. Each stepping region 136 also may include an embossed or printed image of a foot 144 (the foot may be illustrated as a shoe (as shown), or bare, or otherwise depicted) to visually instruct the user how to use the device.

The pad 124 extends across the entire lower surface 122 of the base plate 102, to lie below the rigid central region 130 and the flexible end regions 132. The pad 124 may be connected to the bottom of each stepping region 136 by hook-and-loop fasteners or other connection mechanisms. For example, as shown in FIG. 2, the pad 124 may comprise a number of "loop" elements 200 of a hook-and-loop fastener system, and a number of "hook" elements 202 of the hook-and-loop fastener system may be connected to the lower surface 122 of the base plate 102 at locations to connect with the "loops" on the pad 124. In this embodiment, at least some of the hook-and-loop connections are provided between the rigid central region 130 and the pad 124, and each flexible end region 132 may be connected to the pad 124 by a respective hook-and-loop connection. In other embodiments, there may be no connections between the pad 124 and the flexible end regions 132, which may be desirable to allow large deflections of the flexible end regions 132. It is also envisioned that the pad 124 may only be connected to the flexible end regions 132 and not to the rigid central region 130.

FIG. 3 is a top view of one lateral end of an exemplary base plate 102. In this embodiment, the flexing regions 134 comprise parallel slots 138 that divide the flexing region into parallel ribs 142. The slots 138 may be parallel with the lateral direction 126, but more preferably are angled (i.e., at a non-zero angle) relative to the lateral direction 126, such as shown. For example, in the shown embodiment, the parallel slots 138 are all angled forward, such that each slot opening's distal end 300 (i.e., the end furthest from the joint 110) is in front of each slot opening's proximal end 302 (i.e., the end closest to the joint 110). The forward angle θ preferably is between 2° and 45°, but other angles may be used.

The use of forward-angled slots 138 may provide beneficial dynamics to the operation of the mop 100. In particular, the angled slots 138 may tend to resist deformation when the base plate 102 is moved forward, and may tend to permit deformation when the base plate 102 is moved backwards. FIG. 4 illustrates the exemplary base plate 102 of FIG. 3 as it is being pulled backwards in the longitudinal direction 400, as shown by Arrow A. As the base plate 102 moves, friction between the surface 128 and the bottom of the pad 124 acts in a direction, shown by Arrow B, that is opposite the direction of movement (Arrow A). This friction pulls on the stepping regions 136, which causes them to flex forward relative to the rigid central region 130. This movement may reduce the amount of drag experienced by the user as the base plate 102 is pulled backwards, to reduce fatigue.

During the forward stroke, the angled slots 138—and, more particularly, the forward-angled ribs 142 that form the structure of the flexing region 134—are expected to resist deformation and prevent the stepping regions 136 from moving backwards relative to the rigid central region 130. As shown in FIG. 5, during this motion, the user typically generates a motive force M to move the base plate 102 forward, and this motive force M is resisted by a friction force F generated in the plane of the surface 128. In a normal mop that has a rigid base plate, it is expected that this friction force will be distributed over a large area of the pad 124. However in the shown embodiment, it is believed that the flexing regions 134, acting in concert with the friction force F, may cause the stepping regions 136 to tilt downward so that the leading edge 404 of each stepping region 136 presses down against the surface 128, while the trailing edge 406 may lift slightly. This may help generate a concentrated vertical force at the front of each stepping region 136 to help enhance cleaning at those locations.

It will be appreciated that the foregoing description of certain theories of operation are provided merely as non-binding explanations of the dynamics of the exemplary embodiment. The invention is not intended to be bound to any particular dynamic operation or theory of operation.

Furthermore, while the use of forward-angled slots 138 is described above as part of the flexing region 134, it will be appreciated that such slots 138 are not strictly necessary in all embodiments.

Referring to FIG. 6, in some embodiments, the flexible end regions 132 may be sufficiently flexible to allow the stepping regions 136 (and possibly the flexing regions 134) to flex upwards to press the pad 124 against baseboards 600, walls, or other upright or vertical objects. In these embodiments, it may be helpful to form the flexing region 134 as a solid part (i.e., to exclude slots or other openings), or to provide slots 138 having multiple ribs 142 to press the cleaning pad 124 into the corner between the baseboard 600 and the floor surface 128. If cleaning of upright objects is particularly desired, the flexing regions 134 may be formed with one or more notches on the upper surface that extend in the longitudinal direction 400, to provide hinge-like connections that can fold around a small radius. This may help position the pad 124 as far into the corner as possible.

As will be apparent from FIG. 6, it may be necessary or desirable for the cleaning pad 124 to flex upwards with the flexible end regions 132. To this end, the cleaning pad 124 may include stretchable regions comprising elastic materials, or may comprise a loose fibrous weave that permits sufficient stretching to move with the base plate 102 through its desired range of movement. Alternatively, the connections that joint the cleaning pad 124 to the base plate 102 may provide the necessary movement, or, where only small amounts of deflection are desired, it may not be necessary to make any specific accommodation to account for the movement of the flexible end regions 132. The embodiment of FIG. 6 shows a relatively significant degree of movement, and it will be appreciated that this amount of movement may not be necessary or desirable in all embodiments.

Figure 7:
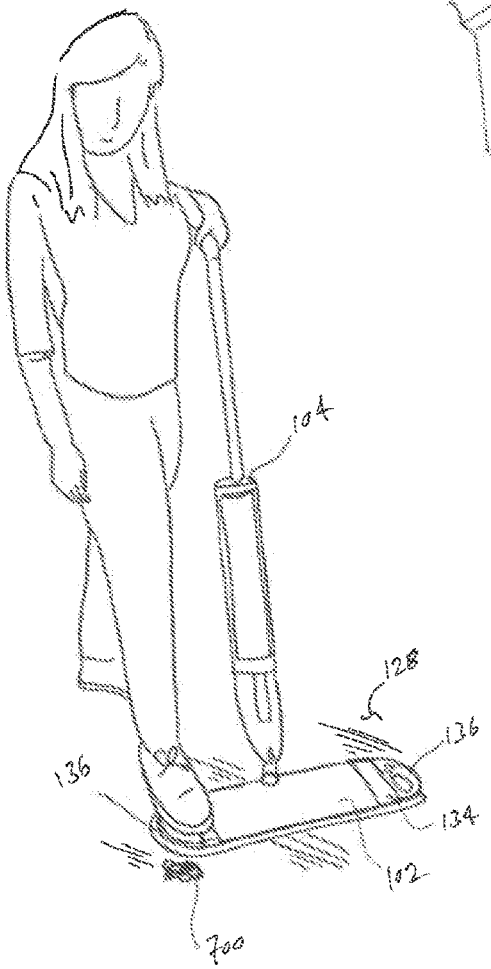
FIG. 7 illustrates an exemplary embodiment of a spray mop having a flexible scrubbing head in one mode of use.

A mop 100 such as described above may be used generally as a conventional floor mop to clean lightly-soiled floors. However, when the user encounters a patch of stubborn dirt 700, the user can generate a highly-concentrated cleaning force to remove the stubborn dirt simply by placing one of the stepping regions 136 over the dirt, stepping on the stepping region 136, and moving the base plate 102 back and forth using the user's foot. An example of this operation is illustrated in FIG. 7. When performing this operation, the flexing region 134 allows the stepping region 136 to move somewhat independently of the rigid central region 130 of the base plate 130. For example, the flexing region 134 can pivot downwards (towards the surface 128) relative to the rigid central region 130 about a first longitudinal axis 146, while the stepping region pivots upwards relative to the flexing region 134 about a second longitudinal axis 148 that is spaced from the first longitudinal axis 146 (see FIG. 1). (The first and second longitudinal axes 146, 148 are parallel, but this is not required in all embodiments). Since the rigid central region 130 and stepping region 136 can rotate somewhat independently on the flexing region 134, forces applied to the stepping region 136 are effectively decoupled from the rigid central region 130. Thus, the force applied by the user on the stepping region 136 does not significantly spread across the entire base plate 102, and instead generates a localized high scrubbing force (i.e., high force per unit area) directly beneath the stepping region 136. FIG. 7 shows the base plate 102 having unapertured flexing regions 134 (i.e., there are no holes through them), but the same operation would be used to operate a mop 100, such as shown in FIG. 1, that has an apertured flexing region 134.

This is expected to provide significantly improved concentrated cleaning results as compared to attempting the same technique using a conventional mop base plate. Conventional base plates generally comprise a single unitary rigid structure, structures that might move relative to one another, but not allow the ends to bend downwards relative to the rest of the base (e.g., telescoping end pieces), or structures that have a single rigid end plate that pivots on the central plate. Stepping on one end of a conventional base plate such as these results in the force being distributed across the width of the base. Even in mops with pivoting end plates, it is believed that the use of conventional "piano" hinges makes it difficult to effectively isolate forces applied at the end plate from the rest of the base plate because they rigidly hold the two plates along the pivot axis, and such rigid hinges may not survive vigorous applications of force. As a result, it is believed that the construction of conventional devices reduces or prevents the generation of a localized concentration of force that may be necessary or desirable to clean a stubborn patch of dirt. In addition to providing a capability not found in conventional rigid base plates, the foregoing operation is quick, simple and intuitive, and should not interrupt the normal process of mopping the floor. Furthermore, using a device as described above can eliminate or greatly reduce the need for the user to bend over to manually scrub stubborn dirt off the floor by hand.

Persons of ordinary skill in the art reading the present disclosure will appreciate that the foregoing exemplary embodiments may be modified in a number of ways. For example, the single cleaning pad 124 could be replaced by multiple pads, with one pad under the rigid central region 130 and separate pads under the flexible end regions 132. The flexible end regions 132 also could use different cleaning elements than the rigid central region 130 (e.g., brushes instead of a replaceable pad). As another example, the rigid central region 130, flexing regions 134 and stepping regions 136 may be molded as an integral elastomeric material, and the rigid central region 130 (and the stepping regions 136, if desired) may be reinforced or structurally modified (e.g., thickened) to provide additional stiffness relative to the flexing regions 134.

Figure 8:
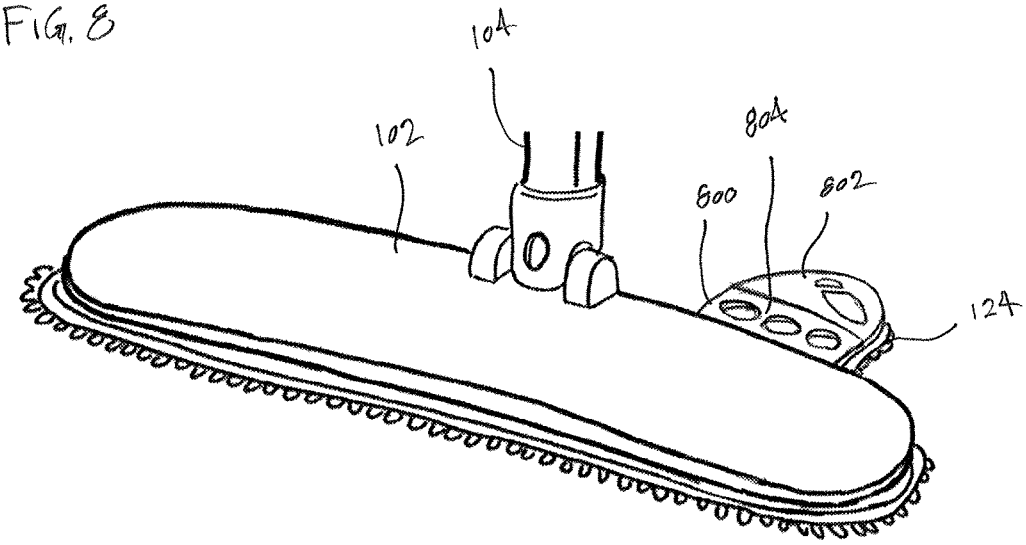
FIG. 8 is an isometric view of an alternative embodiment of a base plate for a spray mop.

As another example, shown in FIG. 8, the flexible end regions 132 may be replaced by a flexing region 800 and stepping region 802 that extend from the back edge of the base plate 102. The construction of this embodiment may otherwise be the same as described elsewhere herein, but the pad 124 may be reshaped to cover the entire base plate 102 and the flexing region 800 and stepping region 802. In still other embodiments, the flexing region and stepping region may extend from the front edge of the base plate 102.

Figure 9:
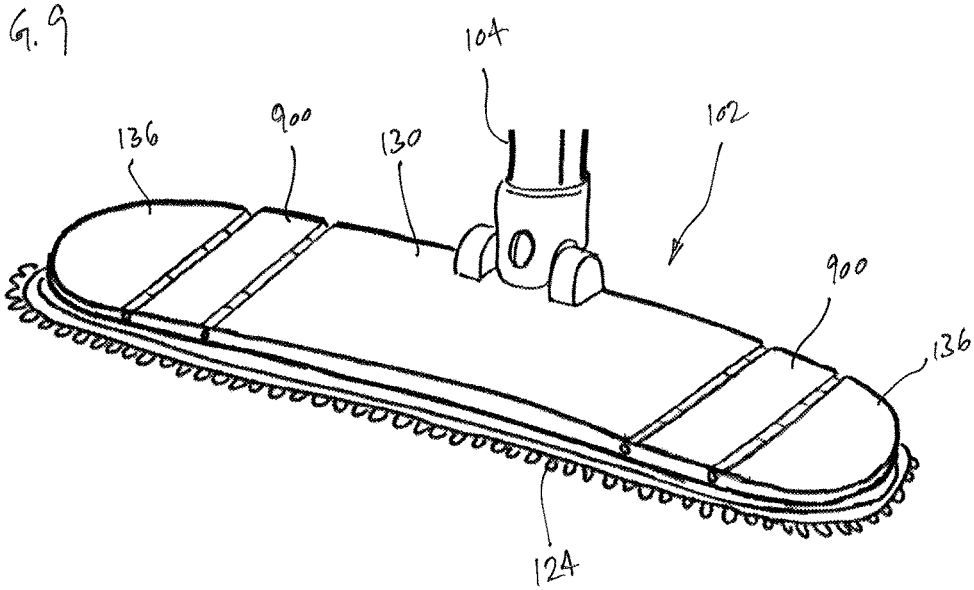
FIG. 9 is an isometric view of another alternative embodiment of a base plate for a spray mop.

In still other embodiments, the flexing region may be replaced by a rigid link 900, as shown in FIG. 9. The link 900 is pivotally connected at an inboard edge to the rigid central region 130 by a first hinge, and is pivotally connected at an outboard edge to the stepping region 136 by a second hinge. Simple piano hinges or the like could be used to make these connections. The link 900 also could include one or more resilient members (e.g., springs or the like) to bias the linkage 900, rigid central region 130 and stepping regions 136 into a planar configuration for use as a normal floor mop. The exemplary embodiment of FIG. 9 would be used like the foregoing embodiments, but in this case the two pivoting connections provided by the link 900 allow the stepping region 136 to move substantially independently of rigid central region 130 so that a user can apply a concentrated cleaning force by stepping on the stepping region 136.

Figure 10A:
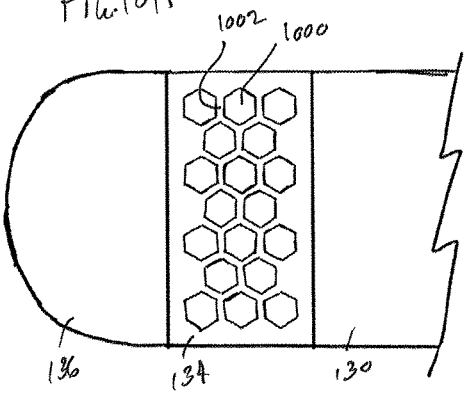
FIGS. 10A-10F are fragmented top views of alternative base plate flexible end regions.
Figure 10B:
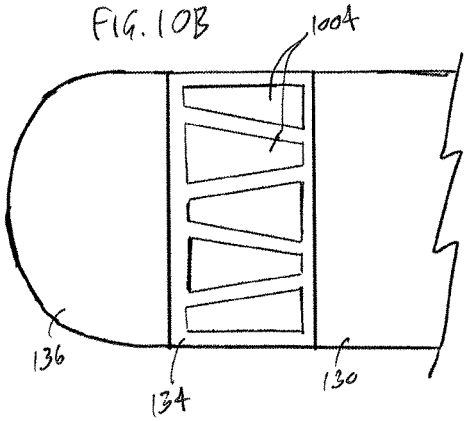
Figure 10C:
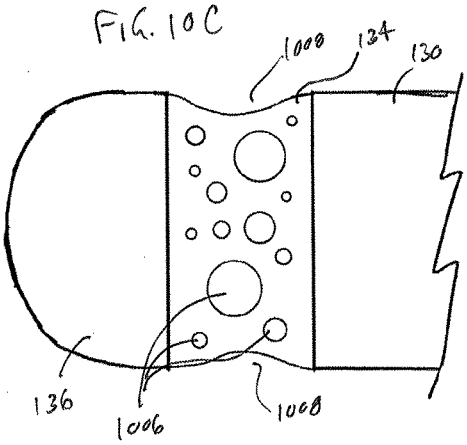
Figure 10D:
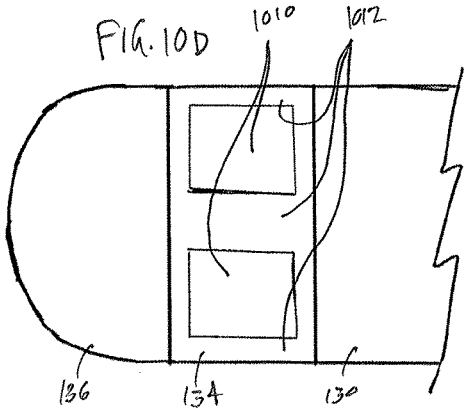
Figure 10E:
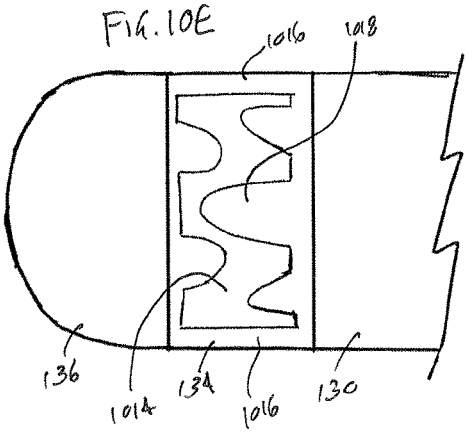
Figure 10F:
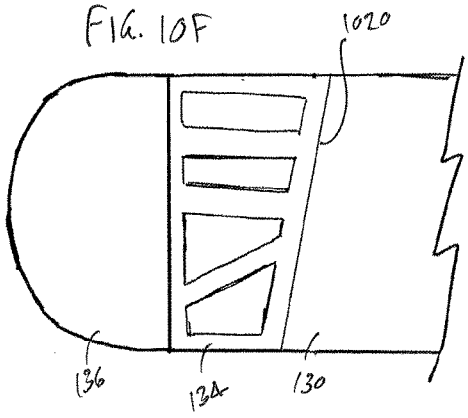

As noted above, the flexing regions 134 may comprise openings having a variety of shapes. FIGS. 10A-10F illustrate alternative embodiments having different exemplary shapes for the openings. In FIG. 10A, the openings 1000 comprise a honeycomb pattern to form a hexagonal pattern of interconnected ribs 1002. This pattern can be replaced by another regular two-dimensional arrangement of shapes (e.g., square openings to form a rectilinear grid of ribs) in other embodiments. FIG. 10B shows the openings 1004 in the form of trapezoids, and variations on this embodiment may comprise rhombus, parallelogram or other quadrilateral shapes. FIG. 10C shows the openings 1006 as a random or pseud-random arrangement of circular openings, but other ovoid or curved shapes may be used. The embodiment of FIG. 10C also shows openings 1008 formed in the front and rear edges of the flexing region 134. FIG. 10D shows an embodiment having two large square openings 1010 that leave three ribs 1012 joining the stepping region 126 to the rigid central region 130. FIG. 10E shows a single opening 1014 having two complete ribs 1016 joining the stepping region 136 to the rigid central region 130, and a one or more partial ribs 1018 extending into the opening 1014. The partial ribs 1018 may be helpful to press downward on the cleaning pad 124 when the flexing region 134 is in a deformed state, such as shown in FIG. 6. Such partial ribs 1018 may be used in other embodiments, as well. FIG. 10F shows another example in which the flexing region 134 is joined to the rigid central region 130 along a line 1020 that is not perpendicular to the lateral direction 126, and not parallel to the longitudinal fore-aft direction 400. In this embodiment, the flexing region 134 would tend to pivot about the axis of the connecting line 1020, which may be helpful to allow the stepping region 136 to lift up during contact with obstacles. Other embodiments may use other opening shapes, use a variety of opening shapes, or omit them entirely.

In each of the embodiments having openings in the flexing region 134, the stepping region 136 is connected to the rigid central region 130 by a plurality of flexible connecting webs. The shapes of the openings and webs can be modified for various purposes. For example, as described in relation to FIGS. 3 and 4, the shapes may be selected to promote deformation in the plane of the floor surface some movements, but not during other movements. Other purposes (e.g., uniform deformation during forward and backward strokes or increased deformation along the lateral axis 126) may be obtained using other designs. These and other variations are contemplated by this disclosure, and other variations and modifications will be apparent to persons of ordinary skill in the art in view of the present disclosure.

It will also be appreciated that the openings may be replaced, in whole or in part, by cutouts (e.g., grooves, divots or the like) that do not pass entirely through the flexing region 134. The foregoing embodiments relating to openings are all suitable for modification by replacing the opening with a cutout having the same or a similar shape, and other variations and modifications will be apparent to persons of ordinary skill in the art in view of the present disclosure.

Figure 11:
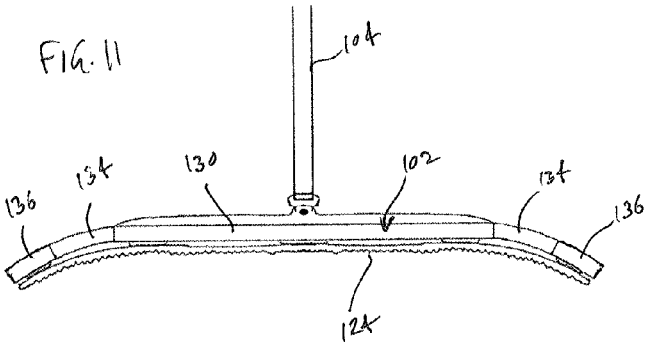
FIG. 11 is a front view of another exemplary base plate.

Embodiments as described herein (or other embodiments) also may include features to help distribute the cleaning force applied by the base plate 102 across the full width of the base plated 102. Referring to FIG. 11, in one embodiment, lower surface 122 of the base plate 102 may have an arched profile in the lateral direction 126. In this embodiment, pressing the base plate 102 flat against the underlying surface causes the flexible end regions 132 to flex upwards to lie flat on the surface. This generates tension along the lower surface 122 of the base plate 102 that tends to distribute a greater downward force towards the flexible end regions 132 than might otherwise exist if the base plate 102 was flat to start with. The arched profile may be provided by curving some or all of the parts. For example, the rigid central region 130, flexing regions 134 and stepping regions 136 all may be formed with a downward curve. Alternatively, only the flexing regions 134 may be curved downward. Other variations and modifications will be apparent to persons of ordinary skill in the art in view of the present disclosure.

Figure 12:
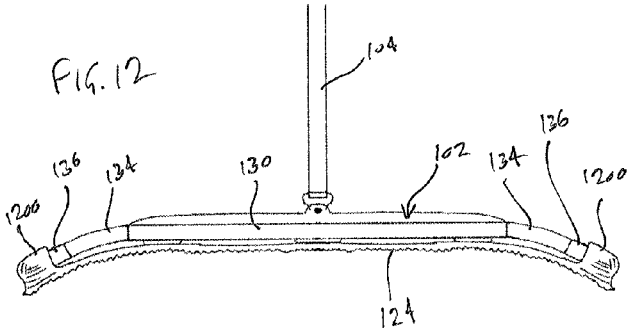
FIG. 12 is a front view of another exemplary base plate.

In an alternative embodiment, such as shown in FIG. 12, the base plate 102 is provided with a downward arch to pre-stress the flexible end regions 132 via the cleaning pad 124. In this embodiment, the cleaning pad 124 is connected to each lateral end of the base plate 102 by pockets 1200 that wrap around part or all of each stepping region 136. The cleaning pad 124 is dimensioned so that the flexible end regions 132 must be bowed downward to install the pockets 1200 over the stepping regions 136. The cleaning pad 124 may include flexible materials or comprise a compliant structure that allows is to lie flat when the base plate 102 is pressed into the surface being cleaned. It should also be appreciated that it is not strictly necessary in all embodiments for the flexible end regions 132 to be allowed to flex upwards relative to the rigid central region 130 (i.e., they may only flex downwards), in which case the cleaning pad 124 may be designed so that the pockets 1200 prohibit further upward movement once the flexible end regions 132 are horizontal with the rigid central region 130. In other embodiments, other connections may be provided between the cleaning pad 124 and the base plate 102 to provide a pre-stressed arrangement such as shown in FIG. 12.

Aspects of the foregoing embodiments are generally directed to a base plate 102 that decouples a downward force applied to the stepping region 136 from the rigid central region 130, in order to allow a user to apply a concentrated cleaning force by stepping on the stepping region 130. While the foregoing embodiments use a flexible end region to provide this decoupling effect, it is anticipated that other configurations may provide the same benefit. One example of an alternative embodiment is shown in FIGS. 13 and 14.

Figure 13:
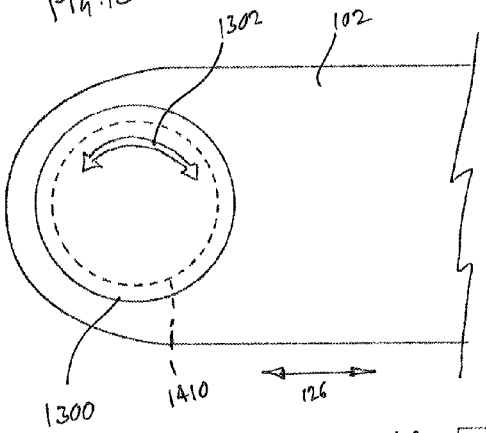
FIG. 13 is a fragmented top view of another embodiment of a base plate.
Figure 14:
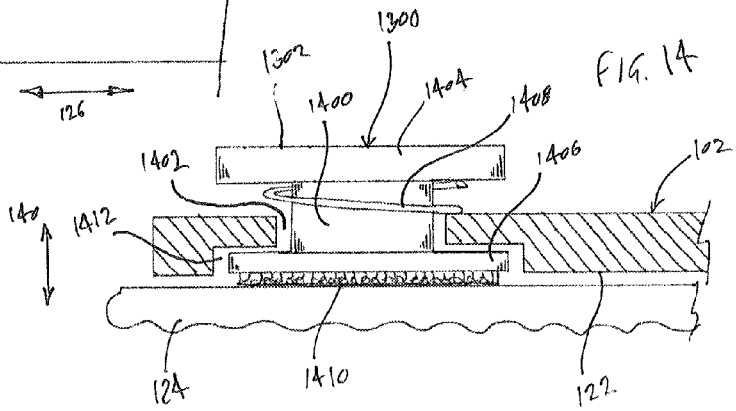
FIG. 14 is a cross-sectional view of the base plate of FIG. 13.

FIGS. 13 and 14 show one lateral end of a base plate 102 that is provided with a decoupled concentrated cleaning step 1300. In this embodiment, the base plate 102 is rigid across its entire lateral width, and the step 1300 is mounted to the base plate 102 such that it can move up and down relative to the base plate 102 when stepped on by a user. In this example, the step 1300 is mounted in an opening 1400 such that it can move a short distance in the vertical direction 140 relative to the base plate 102. For example, the step 1300 may have a shaft 1400 that is configured to slide in a corresponding opening 1402, and an upper flange 1404 and lower flange 1406 that are larger than the opening 1402 to capture the step 1300 in place. A spring 1408 biases the step 1300 upwards. The spring 1408 may comprise an elastomeric material (such as described above), or any other suitable resilient structure, such as a metal wire spring or the like.

The upper flange 1404 preferably is shaped and sized to be easily pressed by a user's foot, and may include a symbolic or textual instruction for its use. The lower flange 1406 may include a pad of fastening material 1410 to connect to the cleaning pad 124. The lower flange 1406 also may fit into a recess 1412 on the bottom of the base plate 102, to allow it to lie flush with the rest of the lower surface 122.

The step 1300 may be mounted on a rotatable shaft, to allow a user to twist the step 1300 relative to the base plate 102. In this case, the step 1300 or base plate 102 may include a visual indicator 1302 instructing the user that the step 1300 may be twisted back and forth to help clean stubborn dirt. In this embodiment, it may be particularly desirable to provide a feature to cause the underlying portion of the cleaning pad 124 to twist along with the step 1300. For example, as noted above, the step 1300 may include a pad of fastening material 1410 (e.g., hook-and-loop material) that mates with a corresponding surface or connector on the cleaning pad 124 to provide a firm connection at this point. Alternatively, or in addition, short prongs may extend down from the step 1300 into the cleaning pad 124. The cleaning pad 124 also may be connected or configured to allow movement at this location. For example, the cleaning pad 124 may have a loose region of material that allows twisting with the step 1300, or the nearest adjacent connection between the base plate 102 and the cleaning pad 124 may be relatively remote from the fastening material 1410 on the bottom of the step 1300.

Figure 15:
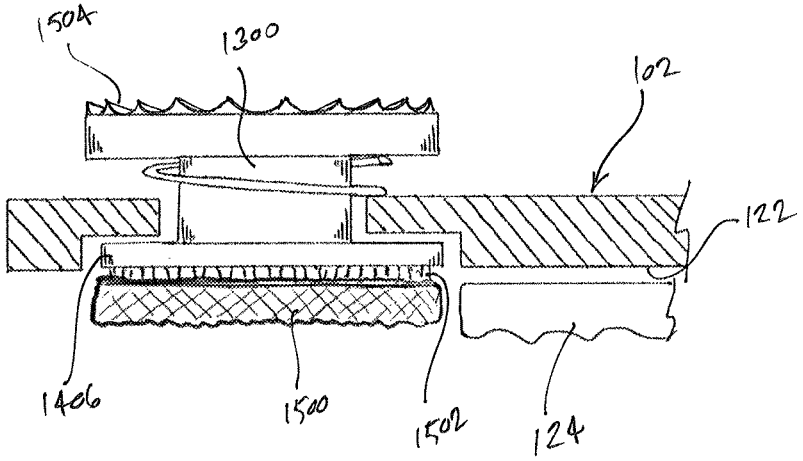
FIG. 15 is a cross-sectional view of an alternative embodiment of the base plate of FIG. 13.

The embodiment of FIGS. 13 and 14 may be modified to provide a different cleaning pad (or other cleaning feature) below the step 1300. For example, FIG. 15 shows one alternative embodiment in which the cleaning pad 124 is modified so that it does not cover the bottom of the step 1300. The cleaning pad 124 may have an opening that surrounds the bottom of the step 1300, or it may stop short of the step 1300 in the lateral direction 126, or it may be otherwise configured. In this embodiment, the lower flange 1406 may comprise a supplemental cleaning pad 1500 that faces the surface. The supplemental cleaning pad 1500 may contact the surface during normal operation (i.e., when the step 1300 is not depressed), or it may lift out of contact with the surface. In either event, when the user applies pressure to the step 1300, the supplemental cleaning pad 1500 applies a greater force to the surface for increased localized scrubbing. The supplemental cleaning pad 1500 may comprise a separate removable pad that identical in general construction to the main cleaning pad 124, or it may have different properties. For example, the supplemental cleaning pad 1500 may comprise a coarser surface than the main cleaning pad 124, or abrasive materials, to provide more aggressive scrubbing.

The supplemental cleaning pad 1500 may comprise a cleaning solution, detergent, or other chemical treatment, to enhance cleaning. Such a chemical treatment may be provided on the surface of the supplemental cleaning pad 1500 (e.g., a layer of mildly-abrasive sodium bicarbonate particles on the surface of a sponge, cloth, or non-woven pad), in encapsulated form to be released upon the application or pressure, or simply as a liquid saturating the material of the supplemental cleaning pad 1500. The step 1300 also may be configured to cooperate with a pump or valve that deposits a cleaning liquid onto the top of the supplemental cleaning pad 1500 or directly on the surface when the user depresses the step 1300. For example, the step 1300 may be located adjacent a pinch valve that normally blocks flow from the tank 112, but that opens when contacted by the upper flange 1404 to allow fluid to pass to the surface by gravitational flow. Such valves are known in the art and need not be described here.

The supplemental cleaning pad 1500 may comprise a removable pad, or a permanently-affixed structure. If it is provided as a removable pad, it may be releasably connected to the bottom of the step 1300 by hook-and-loop fasteners 1502, adhesives, or the like. A permanently-affixed structure may comprise a sponge, a bristle brush that extends downward from the bottom of the step 1300, or the like. Combinations of structures (e.g., a bristle brush that surrounds a removable pad) also may be used. Other variations and modifications will be apparent to persons of ordinary skill in the art in view of the present disclosure.

The step 1300 also may include a textured surface or other surface features that provide a gripping surface to help the user apply a twisting force to rotate the step 1300. If a visual indicator 1302 is provided, it may be configured as a gripping surface. In other embodiments, the top of the step 1300 may include a gripping surface 1504, such as saw-tooth ridges (see FIG. 15), short spikes, raised ribs, a knurled surface, an abrasive material, or the like. Other variations of gripping surfaces will be apparent in view of the present disclosure. For example, the step 1300 may be located anywhere along the base plate 102, instead of being located at a lateral end, and multiple steps 1300 may be provided (e.g., one at each lateral end of the base plate 102).

Embodiments of the present invention may be used in conjunction with any suitable mop. For example, features as described above may be integrated into existing mop models, either as new designs, or as a retrofit kit. Other embodiments may be combined with features described in co-pending U.S. patent application Ser. No. 14/035,455, now abandoned; and 14/035,472, now abandoned, which are incorporated herein by reference.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

We claim:

1. A mop comprising:

a handle having a proximal end, a distal end opposite the proximal end;

a base plate having a lower surface configured to lie on a surface to be cleaned, the base plate extending in a plane defined by a lateral direction and a longitudinal direction that is perpendicular to the lateral direction, the base plate being elongated in the lateral direction and comprising:

a rigid central region having a first lateral end and a second lateral end opposite the first lateral end, the rigid central region being connected to the proximal end of the handle between the first lateral end and the second lateral end, a first flexing region comprising an elastomeric material, the first flexing region being connected at an inboard edge to the first lateral end of the rigid central region and extending in the lateral direction away from the rigid central region to an outboard edge, and a first stepping region connected to the outboard edge of the first flexing region, the first stepping region comprising a generally flat upper surface configured to be stepped on by a user's foot;

wherein the first flexing region comprises a plurality of openings.

2. The mop of claim 1, further comprising a fluid deposition system operatively associated with the mop and comprising:

a tank configured to hold a supply of liquid;

a pump fluidly connected to receive the liquid from the tank;

a sprayer fluidly connected to receive the liquid from the pump; and a trigger configured to operate the pump to deposit liquid through the sprayer and onto the surface to be cleaned.

3. The mop of claim 1, further comprising a cleaning pad located on the lower surface of the base plate, and positioned to contact the surface to be cleaned.

4. The mop of claim 3, wherein the cleaning pad comprises a disposable nonwoven material or a washable pad comprising a one or more woven layers.

5. The mop of claim 3, wherein the cleaning pad is dimensioned to cover the entire lower surface of the base plate.

6. The mop of claim 5, wherein the lower surface of the base plate comprises at least one first pad fastener on a lower surface of the rigid central region and at least one second pad fastener on a lower surface of the first stepping region.

7. The mop of claim 1, wherein the first flexing region comprises at least one of: natural rubber, synthetic rubber, thermoplastic elastomer, and silicone.

8. The mop of claim 1, wherein the mop further comprises a cleaning pad located on the lower surface of the base plate, and the first flexing region is configured to abut the cleaning pad at three or more locations in the longitudinal direction.

9. The mop of claim 1, wherein the first flexing region comprises a plurality of ribs having a respective opening between each adjacent pair of ribs.

10. The mop of claim 9, wherein the plurality of ribs are parallel to one another, and each rib extends at an angle relative to the longitudinal direction.

11. The mop of claim 10, wherein the plurality of ribs are angled forward in relation to a forward working direction of the mop.

12. The mop of claim 1, wherein the upper surface of the first stepping region comprises a generally flat area having a width in the lateral direction of at least about 30 mm.

13. The mop of claim 1, wherein the upper surface of the first stepping region comprises a generally flat area having a length in the longitudinal direction of at least about 30 mm.

14. The mop of claim 1, wherein the upper surface of the first stepping region comprises an image of a foot.

15. The mop of claim 1, wherein the first stepping region comprises a generally flat lower surface facing the surface to be cleaned.

16. The mop of claim 1, wherein the first stepping region comprises an elastomeric material.

17. The mop of claim 16, wherein the first stepping region comprises the same material as the first flexing region.

18. The mop of claim 17, wherein the first stepping region is more rigid than the first flexing region.

19. The mop of claim 1, wherein the rigid central region is configured to rotate relative to the first flexing region about a first longitudinal axis, and the stepping region is configured to rotate relative to the first flexing region about a second longitudinal axis, and wherein the first longitudinal axis is spaced from the second longitudinal axis.

20. The mop of claim 1, wherein the base plate further comprises:

a second flexing region comprising the elastomeric material, the second flexing region being connected at an inboard edge to the second lateral end of the rigid central region and extending in the lateral direction away from the rigid central region to an outboard edge, and a second stepping region connected to the outboard edge of the second flexing region, the second stepping region comprising a generally flat upper surface configured to be stepped on by a user's foot.

* * * * *